US008747244B2

(12) United States Patent
Bolen

(10) Patent No.: US 8,747,244 B2
(45) Date of Patent: Jun. 10, 2014

(54) PUTT BREAK VISUALIZATION INSTRUMENT AND METHOD OF USE THEREOF

(76) Inventor: Gary Mitchell Bolen, Stateline, NV (US)

( * ) Notice: Subject to any disclaimer, the term of this patent is extended or adjusted under 35 U.S.C. 154(b) by 127 days.

(21) Appl. No.: 13/369,242

(22) Filed: Feb. 8, 2012

(65) Prior Publication Data

US 2012/0196694 A1 Aug. 2, 2012

(51) Int. Cl.
*A63B 69/36* (2006.01)
*G01C 9/00* (2006.01)

(52) U.S. Cl.
USPC ..... 473/226; 473/231; 473/238; 473/251; 473/404; 473/409; 33/370; 33/484; 33/508

(58) Field of Classification Search
USPC ..... 473/219, 226, 231, 238, 242, 251, 404, 473/409; 33/508, 483, 484, 485, 370–373
See application file for complete search history.

(56) References Cited

U.S. PATENT DOCUMENTS

| | | | | | |
|---|---|---|---|---|---|
| 139,601 | A * | 6/1873 | Nagle | 33/485 |
| 510,494 | A * | 12/1893 | Wilson | 33/484 |
| 893,478 | A * | 7/1908 | Goehle | 33/485 |
| 1,536,512 | A * | 5/1925 | McLaren | 473/238 |
| 2,429,871 | A * | 10/1947 | De Masters | 403/4 |
| 2,537,473 | A * | 1/1951 | McCusker | 33/27.032 |
| 3,186,092 | A * | 6/1965 | Bertas | 33/277 |
| 3,253,829 | A * | 5/1966 | Ford | 473/238 |
| 3,262,705 | A * | 7/1966 | Nunziato | 473/238 |
| 3,273,893 | A * | 9/1966 | Duncan | 473/238 |
| 3,298,693 | A * | 1/1967 | Eisenberg | 473/238 |
| 4,211,415 | A * | 7/1980 | Lindo | 473/241 |
| 4,607,843 | A | 8/1986 | Signoretti | |
| 5,865,689 | A | 2/1999 | Heyman | |
| 6,716,109 | B1 | 4/2004 | Murtha | |
| 7,419,438 | B2 | 9/2008 | Koiwai | |
| 2008/0207347 | A1 | 8/2008 | Rose | |
| 2010/0144458 | A1 | 6/2010 | Radcliffe et al. | |

FOREIGN PATENT DOCUMENTS

| | | | |
|---|---|---|---|
| RU | 2315642 | C2 | 1/2008 |
| WO | 2004105892 | A1 | 12/2009 |

OTHER PUBLICATIONS

International Searching Authority/RU. International Search Report, International Application No. PCT/US2013/024988, Jun. 14, 2013. 2 pages.

(Continued)

*Primary Examiner* — Sebastiano Passaniti
(74) *Attorney, Agent, or Firm* — David H. Carroll

(57) ABSTRACT

A putt break visualization instrument useful for improving putting includes an elongated object such as a crossbar that extends from the shaft of a putter and is normal thereto. The golfer begins by addressing the golf ball. The golfer then holds the putter above the green by the handle in the manner of a plumb line so that the shaft of the putter is vertically oriented and the crossbar is horizontally oriented. The golfer then aligns the shaft with the uphill edge of the golf ball and moves the shaft up or down along the vertical so that the crossbar extends in proximity to the cup. The golfer may use a slider on the crossbar to mark the cup. The golfer may now evaluate how well he or she has addressed the golf ball, and either repeat the process if improvement is needed or make the putt.

10 Claims, 6 Drawing Sheets

(56) References Cited

OTHER PUBLICATIONS

International Searching Authority/RU. Written Opinion of the International Searching Authority, International Application No. PCT/US2013/024988, Jun. 14, 2013. 4 pages.

Signoretti, Edward J. Golf Greens Leveling Device [online], Jul. 19, 2010 [retrieved on Sep. 6, 2012], Six Pages. Retrieved from the Internet: <URL: http://web.archive.org/web/20100719181621/http://www.ggldgolf.com/>.

Signoretti, Edward J. Golf Greens Leveling Device [online], 2012 [retrieved on Feb. 8, 2012], Eight Pages. Retrieved from the Internet: <URL: http://ggldgolf.com/newsite/>.

Traderedw, Golf Greens Leveling Device Commercial Golf Accessory [online], Oct. 7, 2009 [upload date] [retrieved on Feb. 8, 2012], Two Pages. Retrieved from the Internet: <URL: http://www.youtube.com/watch?feature=player detailpage&v=krl dPmlpge>.

* cited by examiner

PUTT BREAK VISUALIZATION INSTRUMENT AND METHOD OF USE THEREOF

BACKGROUND OF THE INVENTION

1. Field of the Invention

This invention relates generally to the sport of golf, and more particularly to an instrument and a method of use thereof for improving putting.

2. Description of the Related Art

When setting up a putt or lag, the golfer studies or reads the green between the ball and the hole to estimate the path of the ball to the hole, from which the target line and force of the putt is determined. The path of the ball to the hole is greatly influenced by the slope of the green. Unfortunately, the golfer's perception of the slope of the green can be quite inaccurate due to an optical illusion caused the various slopes, lines, patterns, objects and colors within the golfer's view while the golfer reads the green.

Many attempts have been made to design instruments and methodologies for their use to help golfers with their puts. In U.S. Pat. No. 6,716,109 issued Apr. 6, 2004 to Murtha, for example, a putting aid is made of a level affixed to an elongated member which in turn is capable of being detachably secured to the shaft of a putter. The level allows the putter to be more accurately held in a vertical orientation and thereby better serve as a plumb bob. One technique of using the putting aid involves positioning the vertical shaft of the putter over the ball to read the angle between the putter shaft and the horizon. Another technique involves viewing the hole and ball so that both lie along the horizon, and then positioning the vertical putter shaft so that the inner end of the elongated member is aligned with the ball while the outer end is intersects the flag stick. The slope from the ball to the hole is determined by estimating the number of ball thicknesses the elongated member is above the hole. Such golf green leveling techniques may have some utility in measuring the slope of the green in specific areas of the green.

BRIEF SUMMARY OF THE INVENTION

While such golf green leveling techniques and devices may have some utility in measuring slope of the green in specific areas of the green, they do not assist the golfer in visualizing the break in the putted ball and hence the likely path of the putted ball along a sloping green.

One embodiment of the present invention is an apparatus for use on a putter to improve a golfer's putt, comprising an elongated body having a straight edge; a fastener for fastening the elongated body to a shaft of a putter with the straight edge normal to the shaft; and a slider movably disposed on the elongated body in proximity to the straight edge and movable along the elongated body parallel to the straight edge.

Another embodiment of the present invention is a putter comprising a shaft, a handle disposed on an upper part of the shaft, a putter head disposed on a lower part of the shaft, a bar having a straight edge and an elongated face bearing a scale along the straight edge, a collar mounted on the shaft, a joint comprising first and second members rotationally disposed relative to one another, the first joint member being affixed to the collar and the second joint member being affixed to the bar at a midpoint thereof, with the elongated face of the bar facing the collar, a first slider movably disposed along the elongated face of the bar on one side of the midpoint, and a second slider movably disposed along the elongated face of the bar on another side of the midpoint.

Another embodiment of the present invention is a method of improving the putt of a golfer, comprising assuming a putting position behind a golf ball on a green; holding a putter above the green with a shaft thereof in a vertical orientation; during the holding step, maintaining an elongated body having a straight edge oriented to the shaft of the putter with the straight edge thereof normal to the shaft; during the holding and maintaining steps, aligning the shaft of the putter to an uphill edge of the golf ball, and the straight edge of the elongated object proximate a cup on the green; during the alignment step, visualizing the putt break from the shaft of the putter and the straight edge of the elongated body; and making a putt when the putt break is proper for the putt.

DETAILED DESCRIPTION OF THE INVENTION, INCLUDING THE BEST MODE

Figure 1:
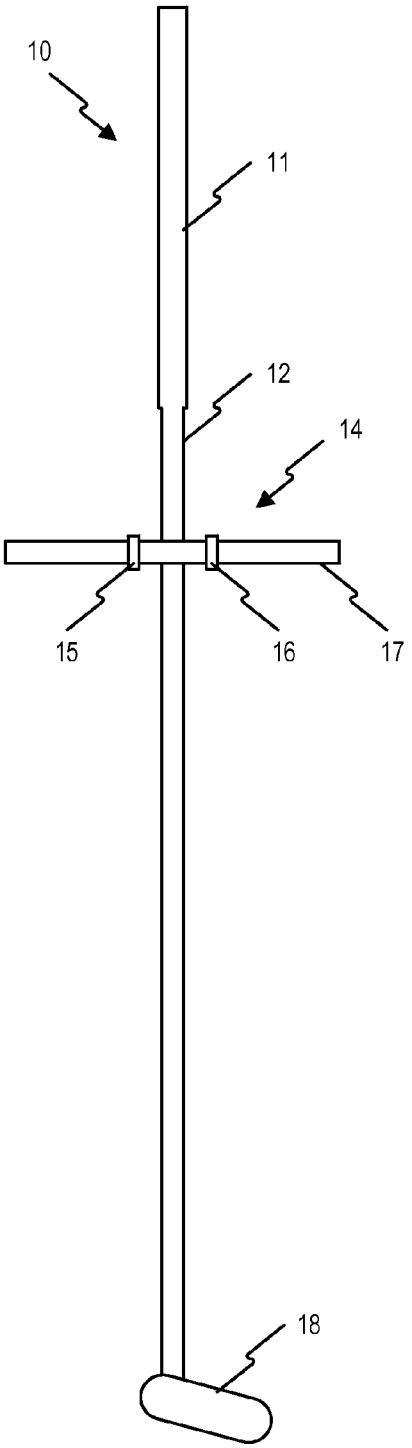
FIG. 1 is a simplified side plan view of a putter having one implementation of a putt break visualization instrument in a deployed position.

The instruments and techniques described herein enable the golfer to better visualize the amount of break in his or her putt, thereby enabling putting with greater accuracy and consistency. FIG. 1 is a simplified side plan view of a putter 10 which has a handle 11, shaft 12, and putter head 18. A putt break visualization instrument 14 illustratively includes an elongated straight-edge member 17 which is normal to and extends equally from both sides of the shaft 12 when in a deployed position. While shown as having a bar, rod or shaft shape, the putt break visualization instrument 14 may be any shape including fan-shaped, triangular, rectangular, and so forth, provided that the bottom includes a straight edge that may be positioned normal to the shaft 12. The putt break visualization instrument 14 may be mounted on or built into the shaft 12 of the putter 10 in any desired permanent or temporary manner. The putt break visualization instrument 14 may include two sliders 15 and 16, one on either side of the shaft 12, which may be used to further contribute to the golfer's ability to visualize the amount of break.

Figure 2:
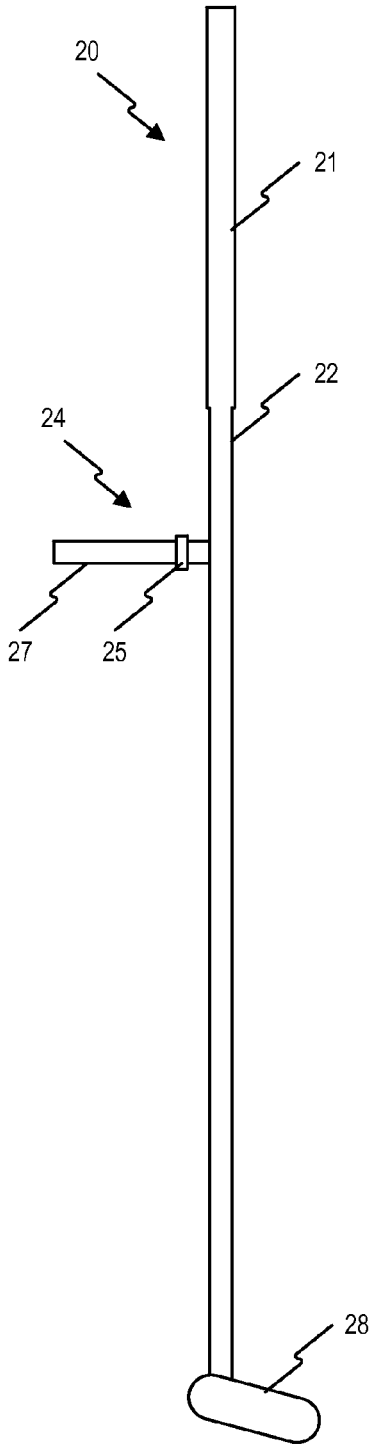
FIG. 2 is a simplified side plan view of a putter having another implementation of a putt break visualization instrument in a deployed position.

FIG. 2 is a simplified side plan view of another putter 20 which has a handle 21, shaft 22, and putter head 28. A putt break visualization instrument 24 illustratively includes an elongated straight-edge member 27 which is normal to and extends from just one side of the shaft 22 when in a deployed position. While shown as having a bar, rod or shaft shape, the putt break visualization instrument 24 may be any shape including half fan-shaped, triangular, rectangular, and so forth, provided that the bottom includes a straight edge that may be positioned normal to the shaft 22. The putt break visualization instrument 24 may be mounted on or built into the shaft 22 of the putter 20 in any desired permanent or temporary manner. The putt break visualization instrument 24 may include a slider 25, which may be used to further contribute to the golfer's ability to visualize the amount of break.

Figure 3:
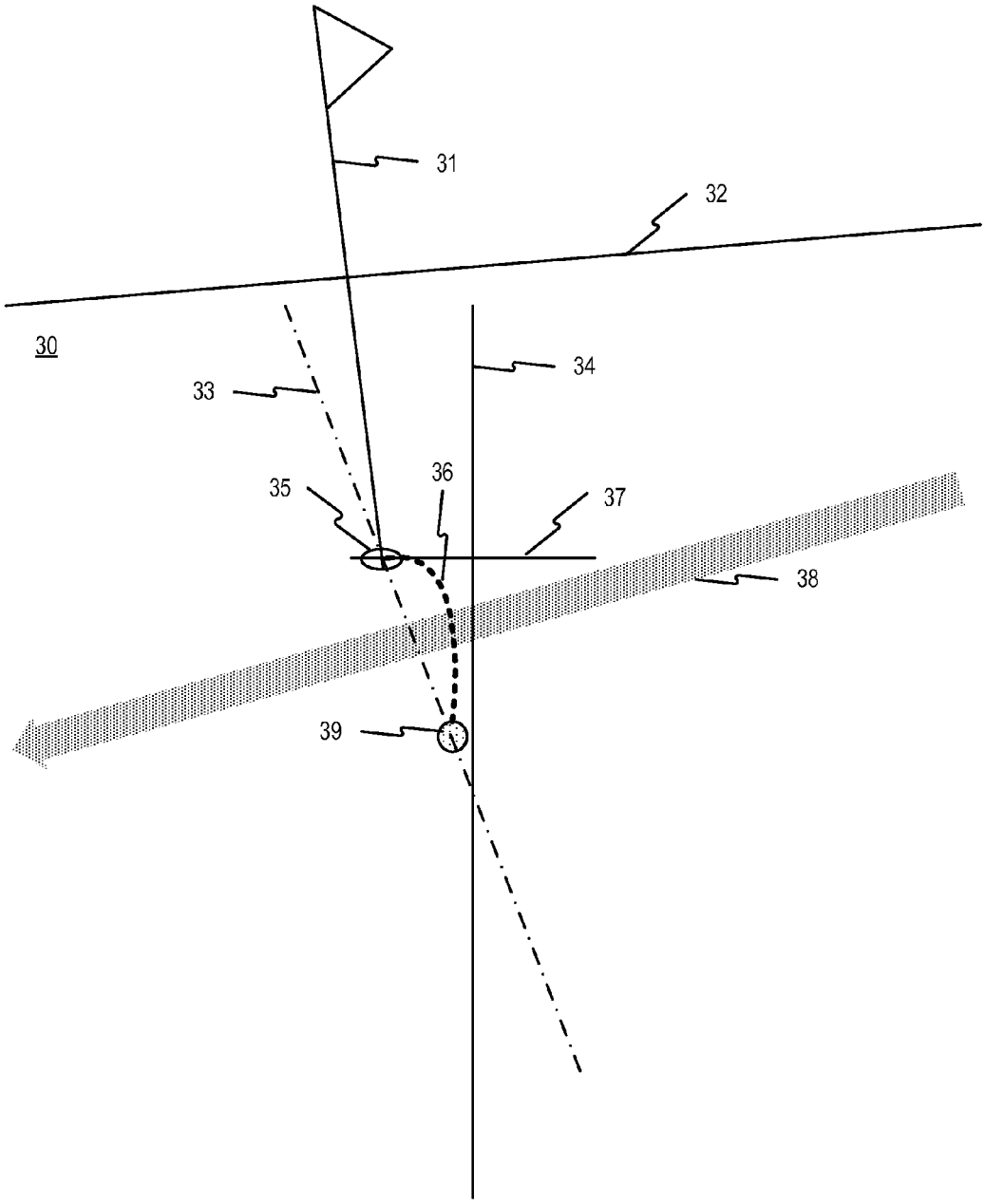
FIG. 3 is a perspective view showing alignment of a putt break visualization instrument for setting up a putt.

FIG. 3 is a perspective view showing is simplified form how a putt break visualization instrument may be used to improve a golfer's putt. The putt break visualization instrument in FIG. 3 is represented by a crossbar 37 which extends from both sides of a shaft 34 of a putter, in a direction normal to the shaft 34. While a crossbar is shown, the visualization instrument may also be represented by a bar (not shown) which extends from only one side of the shaft 34, in a direction normal to the shaft and toward a cup 35. The putter is held above a green 30 like a plumb line so that the shaft 34 is vertically oriented and aligned with the uphill edge, here the right side, of the golf ball 39, while the crossbar 37 is horizontally oriented. The green 30 has a horizon 32 which is shown with a right-to-left downslope, while the green 30 between the cup 35 and a golf ball 39 also has a right-to-left downslope 38 which illustratively is somewhat greater than the downslope of the horizon 32. For reference purposes, a direct line 33 is shown from the golf ball 39 to the cup 35, while a curved path 36 shows the path which the golf ball 39 should travel for a successful putt. The cup 35 may be marked by a flag stick 31. While FIG. 3 is illustrative of a left-breaking putt, a putt break visualization instrument may be used in the same manner to improve a right-breaking putt, in which event the vertically oriented shaft 34 is aligned with the uphill edge, specifically the left side, of the golf ball (not shown).

Figure 4:
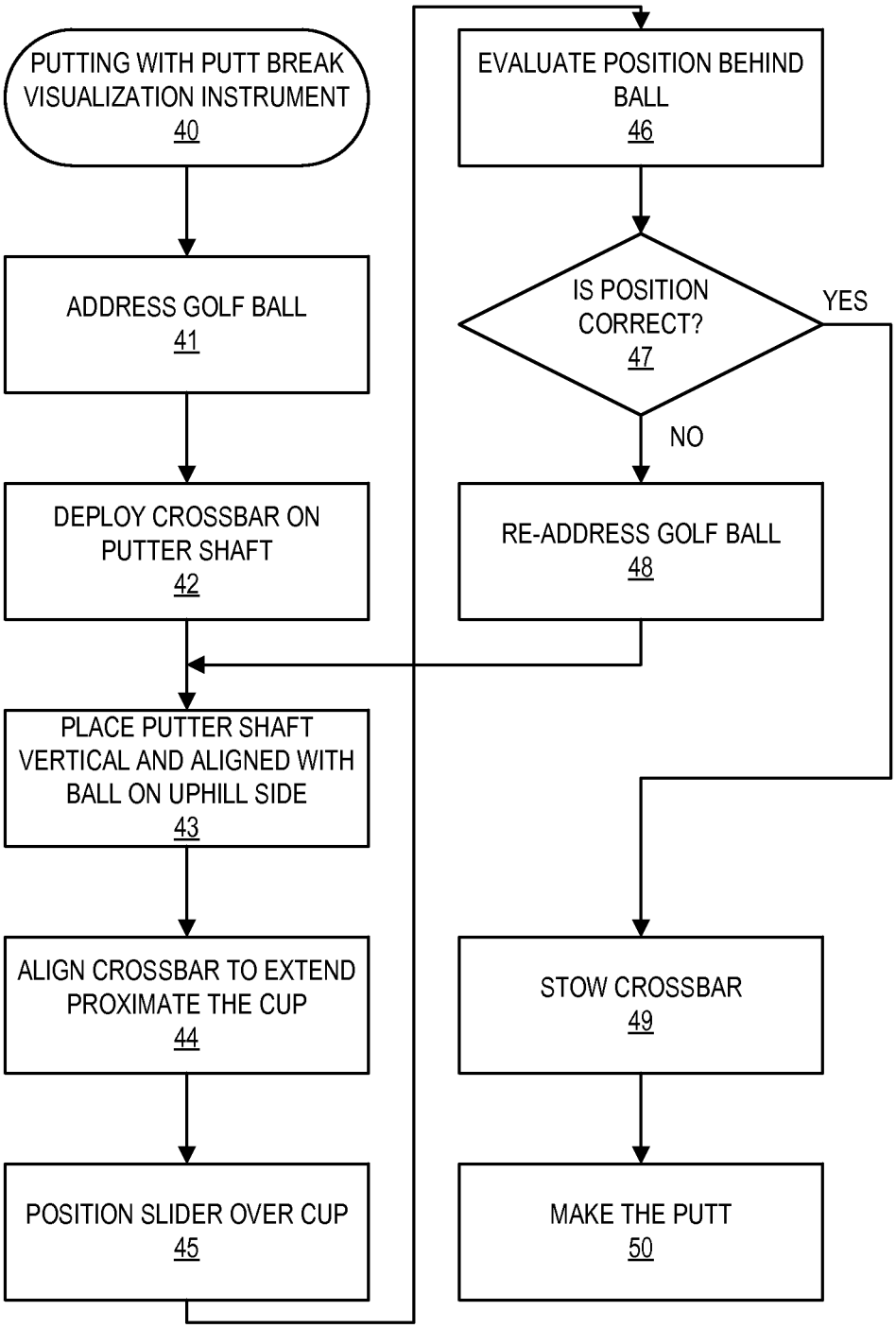
FIG. 4 is a flowchart shown use of a putt break visualization instrument for making a putt.

FIG. 4 is a flowchart 40 showing how a putt break visualization instrument may be used to improve a golfer's putting. The golfer begins by addressing the golf ball 39 (block 41). Either standing or squatting by the golf ball 39, a golfer may either try to "read" the green by ascertain the slope of the green, or may try to visualize the ball rolling off the putter and along the slope of the green into the cup. The golfer then positions himself or herself in the appropriate position behind the golf ball 39 for the putt. Having addressed the golf ball 39, the golfer may deploy the crossbar 37 (block 42). To align the putt break visualization instrument, the golfer holds the putter above the green 30 by the handle in the manner of a plumb line. As a result, the shaft 34 is vertically oriented while the crossbar 37 is horizontally oriented. The golfer then aligns the shaft 34 with the uphill edge of the golf ball 39 (block 43), and moves the shaft 34 up or down along the vertical so that the crossbar 37 extends in proximity to the cup 35 (block 44), either superimposed on the cup 35 or just over or under the cup 35. If more convenient, as may be the case in windy or rainy conditions, the golfer may superimpose the slider on the flag stick 31, although this approach may be somewhat less accurate since the flag stick 31 has a tendency to lean in various ways in the cup 35 and its position is influenced by the wind and actions of other golfers. The putt break visualization instrument may include a level (not shown) on the crossbar 37 to ensure that the crossbar 37 is horizontal. If the golfer wishes to use a slider (block 45), the golfer may move the slider to a position on the crossbar 37 so that it is superimposed on or just over or under the cup 35 or on the flag stick 31, as desired. At this point, the putt break visualization instrument is properly aligned.

Properly addressing the golf ball is a prerequisite to a successful putt. Unfortunately, the golfer's ability to properly address a golf ball on a sloping green often is confused due to an optical illusion caused the various slopes, lines, patterns, objects and colors within the golfer's view while the golfer addresses the golf ball. However, when the putt break visualization instrument is properly aligned, the crossbar 37 (with or without a slider) in conjunction with the shaft 34 focuses the golfer's eye on the relevant region of the green 30 between the golf ball 39 and the cup 35 and allows the golfer to better visualize the path 36 across a sloping green which the golf ball 39 should travel to reach the cup 35. The putting line at the beginning of the path 36 is along and parallel to the shaft 34, but breaks to the left due to the slope 38 and terminates at the cup 35.

With the putt break visualization instrument properly aligned, the golfer may now evaluate how well he or she has addressed the golf ball (block 46). If the golfer is not satisfied with his or her position behind the golf ball 39 (block 47 no), the golfer may again address the golf ball (block 48) and repeat the putt break visualization instrument alignment and evaluation processes (blocks 43, 44, 45, 46, 47). If the golfer is now satisfied with his or her position behind the golf ball 39 (block 47 yes), the golfer may stow the crossbar 37 (block 49) to get it out of the way for the putt, and make the putt (block 50).

Use of the slider enhances a golfer's ability to visualize the amount of break. Moving the slider into a superimposed position on or over the cup 35 or on the flag stick 31 during alignment of the putt break evaluation instrument helps to improve the accuracy of the alignment and acts as a further visual aid to draw the eye to the relevant region of the green 30 so as to avoid a misleading optical illusion.

An illustrative implementation of a putt break visualization instrument 60 is shown in different orthogonal plan views in FIGS. 5-8. The putt break visualization instrument 60 includes a bar 63 which is fastened through a joint 67 to a shaft 62 of a putter, just under a handle 61. Illustratively the bar 63 is chamfered at the ends and in cross section, although it may have any desired cross-sectional shape including rectangular, oval and circular, and may be finished at the ends in any desired manner. The joint 67 allows the bar 63 to be placed in either a stowed position parallel with the shaft 62 (FIG. 5) or in a deployed position (FIGS. 6, 7 and 8) with a straight edge 68 (FIG. 6) of the bar 63 perpendicular to the shaft 62. While any of a variety of different types of joints may be used, one suitable type of joint is made of two members which are secured to one another so as to allow rotation about an axis.

Such a joint may be formed, for example, by a boss 65 and a block 64 which has a cylindrical projecting surface for mating with the boss 65 and allowing rotation about the axis of the cylindrical projecting surface. The bar 63 may be affixed to one of the joint members, illustratively the block 64. Any suitable fastener may be used to fasten the other member of the joint 67 to the shaft 62. One suitable type of fastener is in the form of a ring or collar 66 (FIG. 8) which extends from the boss 65 and circumscribes the shaft 62. The collar 66 may be discontinuous so that it may spread open and urged onto the shaft 62, and the ends at the discontinuity may terminate in respective flanges which may be engaged and pulled together by the boss 65 in any desired manner so as to secure the collar 66 on the shaft 62. Alternatively, the discontinuity in the collar 66 may be away from the boss 65 and the ends at the discontinuity may have flanges that are held together by a screw (not shown). Other suitable types of fasteners include clamps, hinges, magnets, adhesives and welds. Certain types of clamps may be used to fasten the bar 63 to the shaft without the need for a joint, and magnets and adhesives may be used to fasten the bar 63 to the shaft 62 through a simple base member (not shown) with a face that conforms to the curve of the shaft 62, without the need for a joint.

Figures 5, 6, 7:
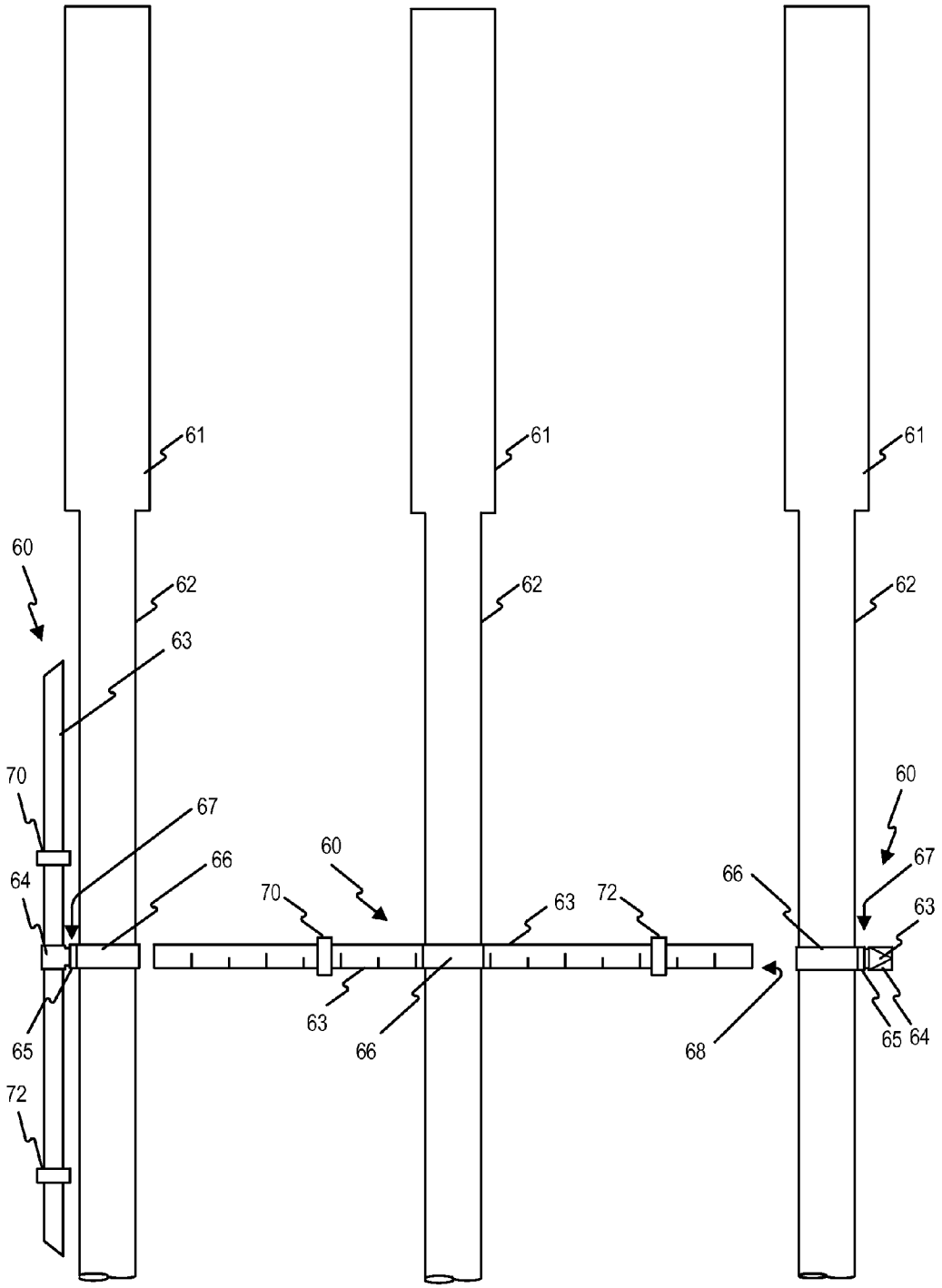
FIG. 5 is a side plan view of a putter and a putt break visualization instrument mounted on the putter and set in a stowed position.
FIG. 6 is a side plan view of the putter of FIG. 3 showing the putt break visualization instrument in a deployed position.
FIG. 7 is a side plan view of the putter of FIG. 3 showing the putt break visualization instrument in a deployed position, from a view normal to the view of FIG. 4.
Figure 8:
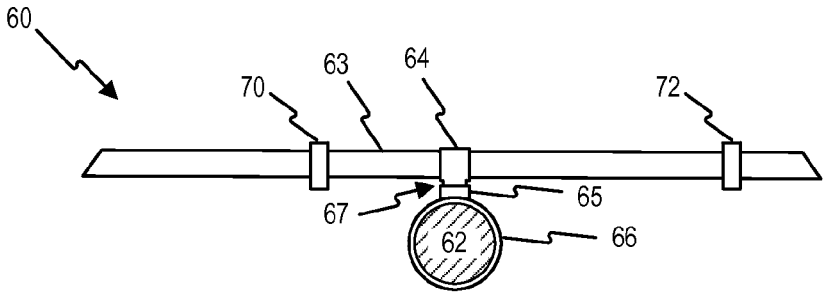
FIG. 8 is a top plan view of the putter of FIG. 3 showing the putt break visualization instrument in a deployed position and the putter shaft in cross-section.

One or more sliders 70 and 72 may be provided on the bar 63 (sliders 70 and 72 are omitted from FIG. 7 to improve clarity). The positions of sliders 70 and 72 as shown in FIGS. 5, 6 and 8 is arbitrary, although the golfer suitably positions one of the sliders 70 and 72 when using the putt break visualization instrument 60. The bar 63 may also have a scale on the inside edge. Illustratively, the putt break visualization instrument 60 may be fastened to the shaft 62 in such a manner that the scale is hidden by the shaft 62 when the putt break visualization instrument is in a stowed position (FIG. 5) and visible to aid the golfer when the putt break visualization instrument is in a deployed position (FIG. 6).

Figure 9:
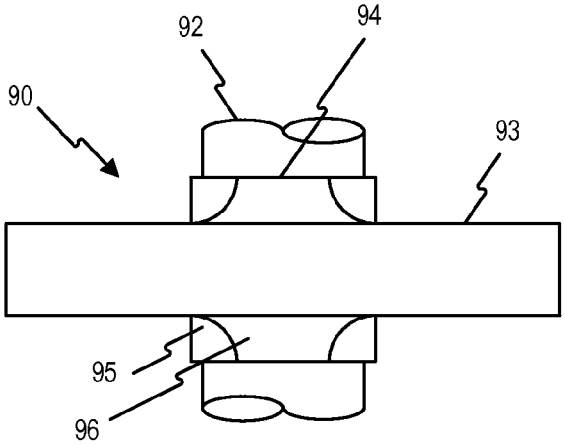
FIG. 9 is a side plan view of another implementation of a putt break visualization instrument in a deployed position.
Figure 10:
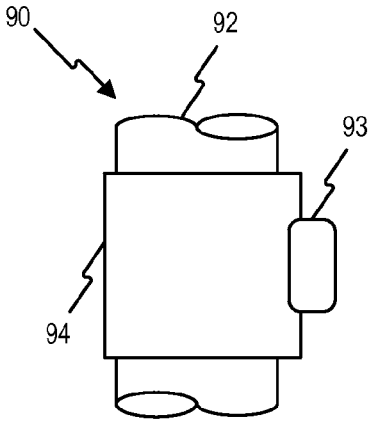
FIG. 10 is a side plan view of the putt break visualization instrument of FIG. 7 from a view normal to the view of FIG. 7.
Figure 11:
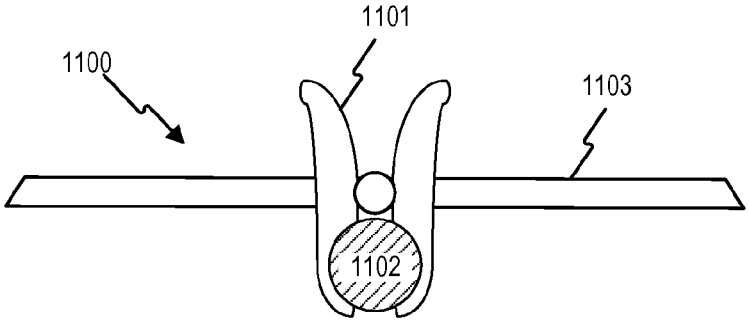
FIG. 11 is a top plan view of another implementation of a putt break visualization instrument in a deployed position on a putter shaft, which is shown in cross-section.
Figure 12:
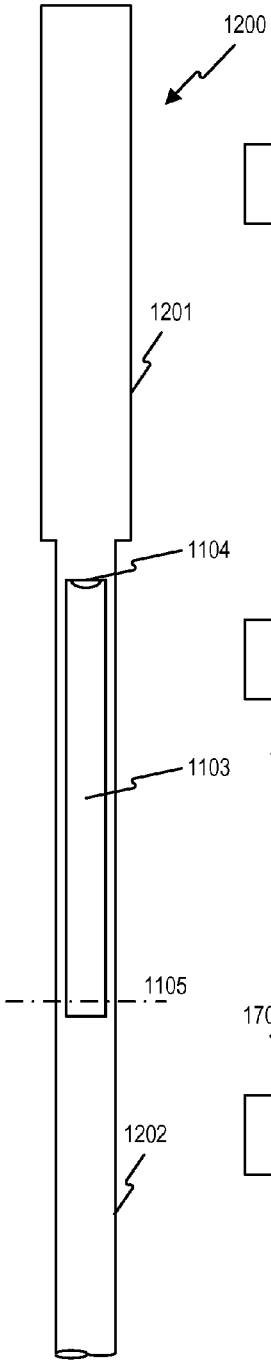
FIG. 12 is a side plan view of a putter and a putt break visualization instrument built into the putter and set in a stowed position.

The implementation of a putt break visualization instrument 60 shown in FIGS. 5-8 is merely illustrative, and many other implementations may be made as desired. FIGS. 9 and 10 are different orthogonal plan views of another suitable implementation 90 in which a block 94 is mounted in any suitable manner to a shaft 92 of a putter. The face of the block 94 contains a recessed region 96 in the form of two crosswise recesses in which a bar 93 may be moved from a deployed position as shown to a stowed position (not shown). The bar 93 may be held to the block by a spring or other elastic material so that it may be rotated as desired but otherwise held in place in one of the crosswise recesses. FIG. 11 shows yet another suitable implementation 1100 in which a bar 1103 is affixed to a clamp 1101 and clamped to or removed from a shaft 1102 as desired. FIG. 12 shows yet another suitable implementation 1200 in which a putt break visualization instrument is built into the shaft 1202 of a putter, just beneath a handle 1201. The built-in putt break visualization instrument has an elongated flap 1103 which is internally hinged along a line of rotation 1105 and retained in place by any suitable internal clip mechanism (not shown). The built-in putt break visualization instrument also has a raised edge 1104 which may be engaged by the finger or fingernail of the golfer so that the flap may be released from the shaft 1202 and allowed to fall to an orientation perpendicular to the shaft 1202. A similar flap may be provided on the opposite side of the shaft 1202, if desired.

Figure 13:
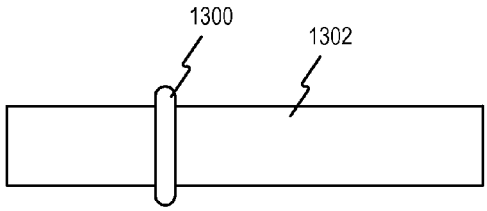
FIG. 13 is a front plan view of one implementation of a slider.
Figure 14:
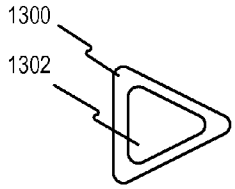
FIG. 14 is end plan view of the slider of FIG. 11.
Figure 15:
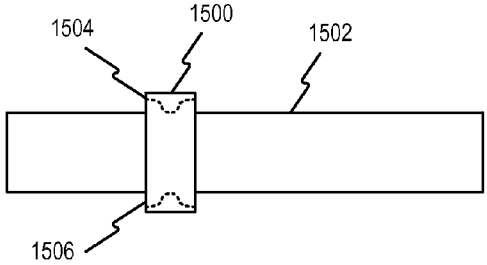
FIG. 15 is a front plan view of another implementation of a slider.
Figure 16:
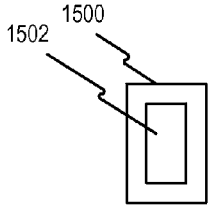
FIG. 16 is end plan view of the slider of FIG. 13.
Figure 17:
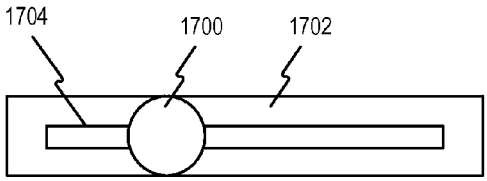
FIG. 17 is a front plan view of another implementation of a slider.
Figure 18:
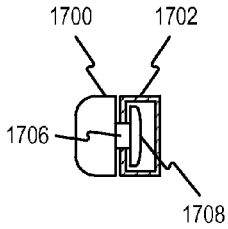
FIG. 18 is end plan view of the slider of FIG. 15.

Sliders may be provided in any desired manner. FIGS. 13 and 14 show a very simple type of slider in the form of a band 1300 of resilient and somewhat slippery material which may be moved by a golfer along a chamfered bar 1302 to any desired position, but which remains in place when the golfer has positioned it. FIGS. 15 and 16 show a rigid slider in the form of a hollow block 1500 of a rigid material, which mounts on a rectangular bar 1502 by having the bar 1502 pass through the hollow interior thereof. Spring-like clips 1504 and 1506 reside between the bar 1502 and respective interior surfaces of the hollow block 1500 to hold the block 1500 in place on the bar 1502 yet allowing the hollow block 1500 to be repositioned as desired. FIGS. 17 and 18 show a slider in the form of a button 1700 that is built into a bar 1702. The button 1700, which may be circular, oval, spherical, square, rectangular, or any other shape, is movable within a channel 1704 in the bar 1702, and is held on the bar 1702 by a retainer formed by a shaft 1706 which passes through the channel 1704 and a head 1708 on the other side of the channel 1704. The button 1700 may be made smoothly slidable by the use of various resilient material or springs (not shown) between the channel 1704 and the button 1700, shaft 1706, and/or head 1708.

Many different materials are suitable for the various implementations of the putt break visualization instrument described herein. Examples of suitable materials include metals, plastics, other polymeric materials, and carbon fiber materials.

The putt break visualization instrument may be made in any size suitable for the size of the putter and for the golfer. For the implementation of FIG. 5 intended for a putter of an average adult, for example, illustratively the bar 63 may be approximately 6.5 inches long or even somewhat shorter, and 0.25 inches wide and deep, and each of the sliders 70 and 72 may be approximately one-sixteenth of an inch wide and slightly in excess of 0.25 inches in height and depth to fit on the bar 63.

The various embodiments of the invention described herein are illustrative of the invention. Any dimensions and materials described herein are illustrative, and are not exclusive of other materials and dimensions. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention, as set forth in the following claims.

The invention claimed is:

1. An apparatus for use on a putter to improve a golfer's putt, comprising:

an elongated body having a straight edge;

a fastener for fastening the elongated body to a shaft of a putter with the straight edge normal to the shaft; and a slider movably disposed on the elongated body in proximity to the straight edge and movable along the elongated body parallel to the straight edge;

wherein the elongated body has a midpoint disposed at the fastener; and wherein the slider comprises a body movably mounted to the elongated body to one side of the midpoint;

further comprising another slider comprising a body movably mounted to the elongated body to another side of the midpoint.

2. The apparatus of claim 1 wherein the elongated body comprises:

a bar;

a rod;

a shaft;

a fan-shaped member;

a triangular member; or a rectangular member.

3. The apparatus of claim 1 wherein the fastener comprises:
a collar;
a hinge member;
a magnet;
an adhesive; or
a weld.

4. The apparatus of claim 1 wherein the slider comprises:
a band of resilient slippery material mounted about the elongated body;
a block of rigid material mounted about the elongated body; or
a button mounted in a channel in the elongated body.

5. An apparatus for use on a putter to improve a golfer's putt, comprising:
an elongated body having a straight edge;
a fastener for fastening the elongated body to a shaft of a putter with the straight edge normal to the shaft;
a slider movably disposed on the elongated body in proximity to the straight edge and movable along the elongated body parallel to the straight edge; and
a joint disposed between the elongated body and the fastener for selectively retaining the elongated body in one of a stowed position parallel to the shaft and a deployed position with the straight edge normal to the shaft,
wherein the joint comprises first and second members rotationally disposed relative to one another, wherein the first member is integrated with the fastener and the second member is integrated with the elongated body.

6. An apparatus for use on a putter to improve a golfer's putt, comprising:
an elongated body having a straight edge, wherein the elongated body comprises a bar, a rod, a shaft, a fan-shaped member, a triangular member, a rectangular member, or any combination of the foregoing;
a fastener for fastening the elongated body to a shaft of a putter with the straight edge normal to the shaft, wherein the fastener comprises a collar, a hinge member, a magnet, an adhesive, a weld, or any combination of the foregoing;
a slider movably disposed on the elongated body in proximity to the straight edge and movable along the elongated body parallel to the straight edge, wherein the slider comprises a band of resilient slippery material mounted about the elongated body, a block of rigid material mounted about the elongated body, a button mounted in a channel in the elongated body, or any combination of the foregoing; and
a joint disposed between the elongated body and the fastener for selectively retaining the elongated body in one of a stowed position parallel to the shaft and a deployed position with the straight edge normal to the shaft, wherein the joint comprises:
first and second members rotationally disposed relative to one another, wherein the first member is integrated with the fastener and the second member is integrated with the elongated body;
first and second hinge members, wherein the first hinge member is integrated with the fastener and the second hinge member is integrated with the elongated body; or
any combination of the foregoing.

7. A putter comprising:
a shaft;
a handle disposed on an upper part of the shaft;
a putter head disposed on a lower part of the shaft;
a bar having a straight edge and an elongated face bearing a scale along the straight edge;
a collar mounted on the shaft;
a joint comprising first and second members rotationally disposed relative to one another, the first joint member being affixed to the collar and the second joint member being affixed to the bar at a midpoint thereof, with the elongated face of the bar facing the collar;
a first slider movably disposed along the elongated face of the bar on one side of the midpoint; and
a second slider movably disposed along the elongated face of the bar on another side of the midpoint.

8. A method of improving the putt of a golfer, comprising:
assuming a putting position behind a golf ball on a green;
holding a putter above the green with a shaft thereof in a vertical orientation;
during the holding step, maintaining an elongated body having a straight edge oriented to the shaft of the putter with the straight edge thereof normal to the shaft;
during the holding and maintaining steps, aligning the shaft of the putter to an uphill edge of the golf ball, and the straight edge of the elongated object proximate a cup on the green;
during the alignment step, moving a slider to a superimposed position proximate the cup and visualizing the putt break from the shaft of the putter and the straight edge of the elongated body, the slider being movably disposed on the elongated body in proximity to the straight edge and movable along the elongated body parallel to the straight edge; and
making a putt when the putt break is proper for the putt.

9. The method of claim 8 comprising repeating the assuming, holding, maintaining, aligning, moving and visualizing steps until the putt brake is proper for the putt.

10. An apparatus for use on a putter to improve a golfer's putt, comprising:
an elongated body having a straight edge;
a fastener for fastening the elongated body to a shaft of a putter with the straight edge normal to the shaft;
a slider movably disposed on the elongated body in proximity to the straight edge and movable along the elongated body parallel to the straight edge; and
a joint disposed between the elongated body and the fastener for selectively retaining the elongated body in one of a stowed position parallel to the shaft and a deployed position with the straight edge normal to the shaft,
wherein the joint comprises first and second hinge members, the first hinge member being integrated with the fastener and the second hinge member being integrated with the elongated body.

* * * * *